United States Patent [19]

Ibrahim

[11] 4,337,626

[45] Jul. 6, 1982

[54] WELL TYPE REFRIGERATED CASE WITH DEFROST AIR INTAKE AND COLLIDING BAND AIR DEFROST

[75] Inventor: Fayez F. Ibrahim, Niles, Mich.

[73] Assignee: Tyler Refrigeration Corporation, Niles, Mich.

[21] Appl. No.: 226,768

[22] Filed: Jan. 21, 1981

Related U.S. Application Data

[63] Continuation-in-part of Ser. No. 145,859, May 1, 1980, which is a continuation-in-part of Ser. No. 107,261, Dec. 26, 1979, Ser. No. 76,669, Sep. 18, 1979, Ser. No. 60,549, Jul. 25, 1979, and Ser. No. 11,804, Feb. 14, 1979.

[51] Int. Cl.[3] ..... A47F 3/04

[52] U.S. Cl. ..... 62/82; 62/256

[58] Field of Search ..... 62/256, 82, 282, 255, 62/80

[56] References Cited

U.S. PATENT DOCUMENTS

| | | | |
|---|---|---|---|
| 2,929,227 | 3/1960 | Rainwater | 62/256 |
| 3,196,626 | 7/1965 | Gabler | 62/256 X |
| 3,226,945 | 1/1966 | Spencer | 62/256 |
| 3,593,358 | 7/1971 | Bachman et al. | 62/256 |
| 4,144,720 | 3/1979 | Subera et al. | 62/256 |
| 4,182,130 | 1/1980 | Ljung | 62/256 X |
| 4,285,204 | 8/1981 | Vana | 62/256 X |

*Primary Examiner*—William E. Tapolcai, Jr.

*Attorney, Agent, or Firm*—LeBlanc, Nolan, Shur & Nies

[57] ABSTRACT

A well type open top refrigerated display case has a primary air conduit extending around the cabinet and main fans for circulating air through the primary conduit and across the open top of the cabinet in the form of an air curtain. A column extends upwardly from and above the well type region; defrost fans are located in a defrost conduit in the column. Defrost control means are provided for energizing the defrost fans at the start of a defrost cycle to draw ambient air from above the refrigerated display case into the upper portion of the defrost conduit at a higher pressure than the air pressure in the region of the open top; a portion of the higher pressure ambient air is directed out of the defrost conduit to collide with the air curtain flowing across the open top, the flow of the air curtain being thereby reversed and caused to flow over the top of and outside the display case. A further portion of ambient air is drawn downwardly by the main fans to flow through the primary conduit and assist in defrosting the coils.

16 Claims, 5 Drawing Figures

WELL TYPE REFRIGERATED CASE WITH DEFROST AIR INTAKE AND COLLIDING BAND AIR DEFROST

CROSS REFERENCE TO RELATED APPLICATIONS

This application is a continuation-in-part of Ser. No. 145,859 filed May 1, 1980, titled *ISLAND REFRIGERATED DISPLAY CASE WITH AIR DEFROST;* Ser. No. 145,859 is, in turn, a continuation-in-part of Ser. No. 107,261, filed Dec. 26, 1979, Ser. No. 76,669, filed Sept. 18, 1979, Ser. No. 60,549 filed July 25, 1979, and Ser. No. 11,804 filed Feb. 14, 1979.

The entire disclosure of Ser. No. 145,859 and the disclosures of its respective parent applications are incorporated herein by reference.

BACKGROUND OF THE INVENTION

The present invention relates to air defrost systems for open top refrigerated display cases. More particularly, the invention relates to an air defrost system in which air bands are caused to flow in opposite directions in defrost to collide and direct colder air outside the case and permit warmer air to flow over the refrigeration coils to defrost them.

All references herein to refrigeration apparatus or refrigeration operations are intended to include cooling at a temperature below 32° F., such as associated with frozen food display cases, or below 0° F., such as with ice cream cases, or in excess of 32° F., such as typically associated with dairy, fresh meat and produce display cases.

The invention is primarily intended for use in, but is not limited to, island type display cases having an ambient air defrost system. Island type display cases are constructed essentially as open top cases with a central member in the well region which divides the case into two parts. The island cases have the general appearance of two open top cases arranged back to back. Separate air conduits are provided for each display section, with the central member providing a common region between the otherwise distinct conduits. Generally, separate sets of refrigeration coils are provided in each conduit to cool the air flowing through the separate conduits during a refrigeration cycle.

A single set of air circulating fans may be provided, generally at the junction between the central common conduit portion and the separate conduit portion to propel the air around the respective display space regions and across the separate open top regions. Alternatively, separate sets of air circulating fans may be provided within the separate conduit regions, each set of fans drawing air from the common central portion into the separate conduit sections.

In the operation of commercial refrigerated display cases, e.g. such as are found in supermarkets and the like, it is desirable to include a system capable of automatically defrosting the display case. Preferably, the defrost cycle is actuated either at preset periodic times or when the frost buildup within the system has reached a certain predetermined level. The system may be controlled to begin the defrost operation at a preset time or times as set on a master control clock; defrost termination is usually thermostatically controlled, with a fail-safe clock-controlled maximum defrost time period. Alternatively, the system may be thermostatically controlled so as to switch from the refrigeration cycle to the defrost cycle when a preset level of frost buildup is detected. By either manner of operation, it is possible to avoid significant frost buildup within the display case.

Typically, three main approaches have been employed in the past for defrosting refrigerated display cases. The first approach involves the use of electric resistance heaters that are arranged adjacent to the refrigeration coils of the refrigeration mechanism. During a defrost cycle, these heaters are energized to radiate heat in an effort to eliminate the frost buildup on the coils; this also adds heat to the air being circulated through the conduit within the case. This electric defrost is relatively simple both in construction and operation. No additional moving parts are required, although it is generally necessary to install an additional three-phase 220 V line for the heater circuit. The electrical heaters are high wattage heaters, and thus utilize a substantial amount of electricity during operation. Furthermore, the additional warm air being circulated in the case due to the radiant heat from the heaters can raise the temperature of the case above desirable limits, thereby increasing the risk of product spoilage.

A second type of defrost system in use circulates relatively high temperature, high pressure compressed gaseous refrigerant through selected evaporator coils in the defrost cycle in the opposite direction to the flow of refrigerant through the evaporator coils during the refrigeration cycle. During the defrost cycle, a valve mechanism shuts off the supply of low temperature liquid refrigerant to the evaporator coils to be defrosted and instead routes the compressed hot gaseous refrigerant through the coils for defrosting. Gas defrost requires additional expensive mechanical components, including an extra several hundred feet or more of refrigerant carrying conduit, valves solenoids, etc. All of these elements are subject to rapid and extreme temperature shifts, and resulting expansion, particularly at the start and end of a defrost cycle. Due to the requirement that the system be able to be selectively switchable to supply hot gaseous refrigerant to selected ones (but not all) the evaporator coils, a complicated valving and control structure must be provided.

A third, relatively recently developed approach to defrosting display cases relies upon naturally warm ambient air. An example of an ambient air defrosting system which has proven to be commercially successful is shown in U.S. Pat. No. 4,144,720 to Subera et al, which is assigned to the same assignee as the present invention. The Subera '720 patent discloses an open front refrigerated display case having primary and secondary air conduits. During a defrost cycle, the direction of air flow through the secondary conduit is reversed to draw in air from outside the display case. This ambient air is directed into the primary band conduit where it is forced to flow over the evaporator coils and defrost them. A feature of the system shown in the Subera '720 patent is that the primary band air flow is continuously maintained in both the refrigeration and defrost cycles, whereby an air curtain is maintained across the access opening at all significant times.

Other reversible fan air defrost systems are shown in U.S. Pat. No. 4,026,121 to Aokage et al and U.S. Pat. No. 4,120,174 to Johnston. Other air defrost systems generally are shown in U.S. Pat. Nos. 3,082,612; 3,403,525; 3,850,003; and 3,937,033, all to Beckwith et al. An open top island type display case using air defrost is disclosed in U.S. Pat. No. 4,182,130, issued Jan. 8, 1980 to Hans G. Ljung.

SUMMARY OF THE INVENTION

The well type open top refrigerated display case of this invention includes primary air conduit means extending around the display space in the case, with air outlets and air inlets located on opposite sides of the display space. Refrigeration coils and main air circulating fans are located in the primary conduit means for circulating air through the primary conduit means and across the open top of the display space between the outlet and inlets in the form of an air curtain during a refrigeration cycle. A column containing a defrost conduit and defrost fans extends upwardly from and above the well type region to a height substantially greater than the height of the cabinet.

Defrost control means are provided for energizing the defrost fans at the start of a defrost cycle to draw ambient air from above the refrigerated display case into the upper portion of the column at a higher pressure than the air pressure in the region of the open top of the display space. A portion of the higher pressure ambient air is directed out of the defrost conduit to collide with the air curtain flowing across the open top, the flow of the air curtain being thereby reversed and caused to flow over the top of and outside the display case. A further portion of the ambient air is drawn downwardly by the main fans to flow through the primary conduit means and assist in defrosting the coils.

DESCRIPTION OF THE PREFERRED EMBODIMENT

Figure 1:
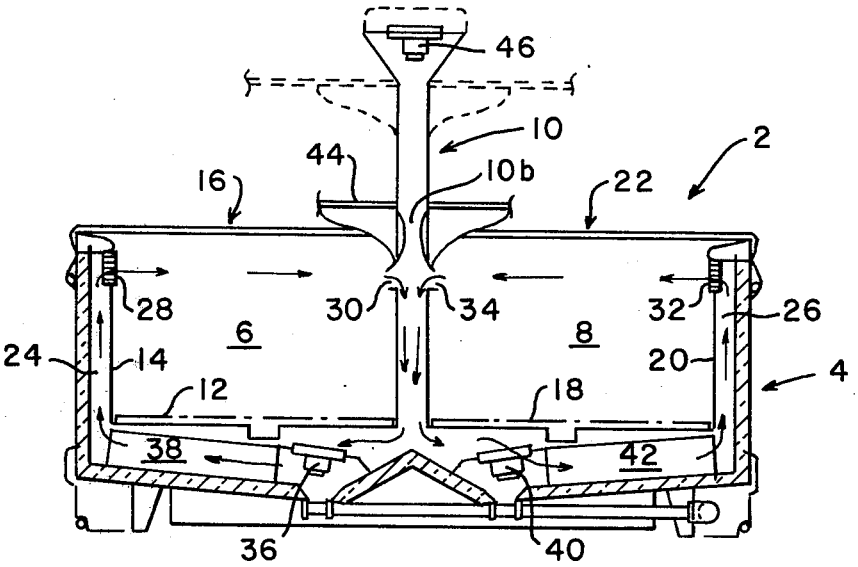
FIG. 1 shows the air defrost arrangement of this invention in conjunction with a single band island type display case.

FIG. 1 shows a single band well type island case, generally designated 2, having an outer cabinet 4, containing back to back storage/display spaces 6 and 8, separated by a central column 10. Display space 6 is further defined by bottom and side walls 12 and 14, respectively, and a top access opening 16. Display space 8 is further defined by bottom and side walls 18 and 20, respectively, and by a top access opening 22.

A first conduit 24 is formed in the space between the outer cabinet 4 and walls 12 and 14 of display space 6. A second conduit 26 is formed in the space between the outer cabinet 4 and wells 18 and 20 of display space 8. Both conduits 24 and 26 share a common return defined by the hollow interior of central column 10. An outlet 28, usually covered by a grille, is disposed near the top of display space 6 along one side of top access opening 16. A corresponding return or inlet opening 30 is located across from outlet 28 in central column 10. An outlet opening 32, usually covered by a grille, is disposed near the top of the display space 8 along one side of the top access opening 22. A corresponding return or inlet opening 34 is located across from outlet 32 on the opposite side of top access opening 22 in central column 10.

A first fan or set of fans 36 and a first set of refrigeration coils 38 are located in conduit 24. A second fan or set of fans 40 and a second set of refrigeration coils 42 are located in conduit 26 analogously to fans 36 and refrigeration coils 38 located in conduit 24.

During the normal refrigeration cycle, air is propelled by fans 36 through conduit 24 over coils 38, in the direction of the arrows in FIG. 1, out through outlet opening 28 and across the top access opening 16 of display space 6 toward and into return or inlet 30. A continuous refrigerated air band is thus created, including an air curtain across top access opening 16. In like manner, fans 40 propel air through conduit 26 over refrigeration coils 42, out through outlet opening 32 in the direction shown by the arrows, across top access opening 22 and into inlet 34. A refrigerated air band thus circulates through conduit 26 and across the top access opening 22 in the form of a refrigerated air curtain.

One or more sets of product display shelves 44 may be mounted to central column 10 for storing and displaying non-refrigerated products. A third fan or set of fans 46 is located at the top of central column 10 to selectively draw ambient air from above the outer cabinet 4 (and refrigerated display spaces 6 and 8) into central column 10 during a defrost cycle.

During a normal refrigeration cycle, fans 46 are shut off and fans 36 and 40 generate and maintain continuous air bands through conduits 24 and 26, and air curtains across the open tops of display spaces 6 and 8, respectively.

At the start of a defrost cycle, the flow of refrigerant through coils 38, 42 is shut off. Concurrently, fans 46 are turned on to draw ambient air into central column 10. Fans 36 and 40 continue to operate in the same manner as they do during the refrigeration cycle to maintain air flowing through conduits 24 and 26.

During the defrost cycle, with fans 46 operating to cause ambient air to flow downwardly through central column 10, the respective return or inlet ducts 30 and 34 are pressurized to a positive pressure with relatively warm air withdrawn from the ambient above the case. The size and/or number of fans 46 is sufficiently large that the volume of air flowing through the lower portion **10*a* of central column 10 (below inlet or return ducts 30 and 34) and through conduits 24 and 26 will be increased during the defrost cycle as compared to the refrigeration cycle. The increased warm air volume flowing over the refrigeration coils 38 and 42 aids in obtaining relatively rapid defrosting of the coils. Preferably and advantageously the central column 10 contains a restricted region 10*b*, located just above the inlets 30 and 34**, which creates a venturi effect in the column and increases the velocity of air flowing downstream of the venturi.

During the defrost cycle, air flowing through conduits 24 and 26 gives up heat to coils 38 and 42. Obviously, if fresh air is not continuously introduced into the air bands in conduits 24 and 26, the air flowing over coils 38 and 42 would soon contain insufficient heat to properly defrost the coils. To accomplish rapid and efficient air defrosting, therefore, particularly in low temperature (e.g. freezer) cases, it is desirable to continuously remove cold air from and introduce warm air into the conduits. This desirable end is achieved by the defrost air flow shown in FIG. 2.

The air pressure inside column 10 is greater than the pressure outside the column in the region of inlets 30 and 34. A portion of the air flowing downwardly through the upper part of central column 10 past venturi section 10*b*, is directed out of inlet ducts 30 and 34 to intersect and collide with the air curtains flowing out of outlets 28 and 32. The air exiting from inlets 30 and 34 is traveling at a higher velocity and therefore has a greater momentum than the air exiting from outlets 28 and 32. The air curtain flow is thus forced to reverse upon itself and flow in the opposite direction over the top of and outside of cabinet 4. In this manner, relatively warm ambient air is continuously drawn into the conduits 24 and 26 to flow over and around coils 38 and 42 to defrost them. At the same time air which has already given up its heat to the coils is exhausted outside the case, away from the ambient air intake at the top of column 10.

In one exemplary embodiment, fans 46 draw air into column 10 at a volumetric rate approximately two times greater than the total volumertric flow rate of fans 36 and 40. For example, each set of fans 36 and 40 may draw air at a rate of about 100 cfm (cubic feet per minute); fans 46 would therefore draw air at a rate of about 400 cfm. Approximately one half the air entering conduit 10 exits from inlets 30 and 34 in about equal amounts (e.g. about 100 cfm per inlet). For best results, column 10 extends at least about eighteen inches above the top of cabinet 4 although a range of about one to two feet in height is commercially acceptable, depending on such factors as the number and size of shelves 44 to be mounted to the outside of column 10.

At present, it is believed that the natural pressure differential occurring at inlets 30 and 34 between the higher pressure side on the inside of column 10 and the lower pressure side outside the column in display spaces 6 and 8, respectively, will be sufficient to naturally divert a portion of the air flow in conduit 10 out through inlets 30 and 34 into the path of the air curtains flowing across access openings 16 and 22 from conduit outlets 28 and 32. If necessary, however, guide vanes 48 and 50 (as shown in FIG. 2) could be provided at inlets 30 and 34 extending partially into the air stream in column 10.

Figure 3:
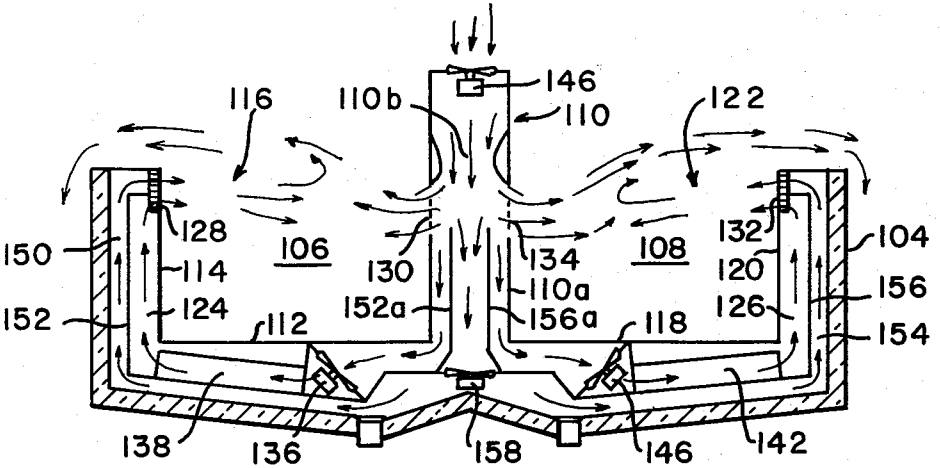
FIG. 3 shows the air defrost arrangement of this invention in conjunction with a multi-band island type display case.
Figure 4:
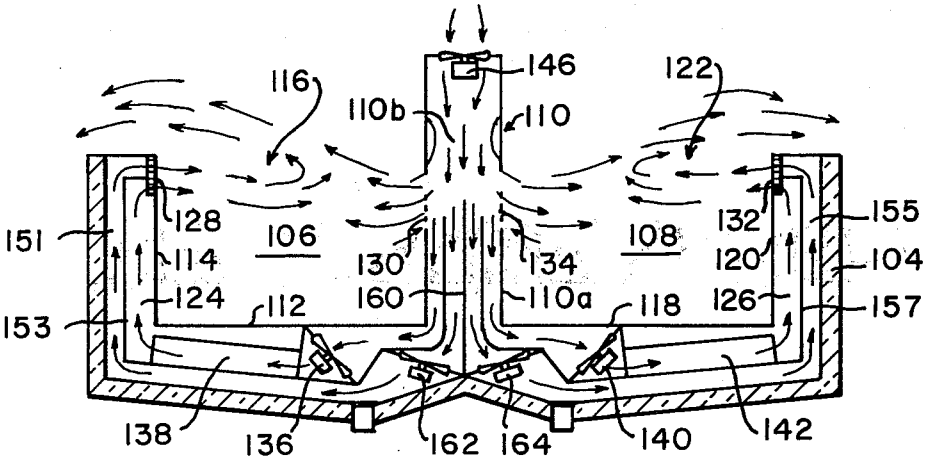
FIG. 4 shows a modified version of the multiband case of FIG. 3.

FIGS. 3 and 4 show variations of a second embodiment of this invention in conjunction with multiband island type display cases. In these Figures, similar elements corresponding to those shown in the embodiment of FIG. 1 and described above are designated by like reference numerals in the 100 series; thus outer cabinet 104 shown in FIGS. 3 and 4 corresponds to outer cabinet 4 in FIG. 1, display spaces 106 and 108 in FIGS. 3 and 4 correspond to display spaces 6 and 8, respectively, in FIG. 1, etc.

Figure 2:
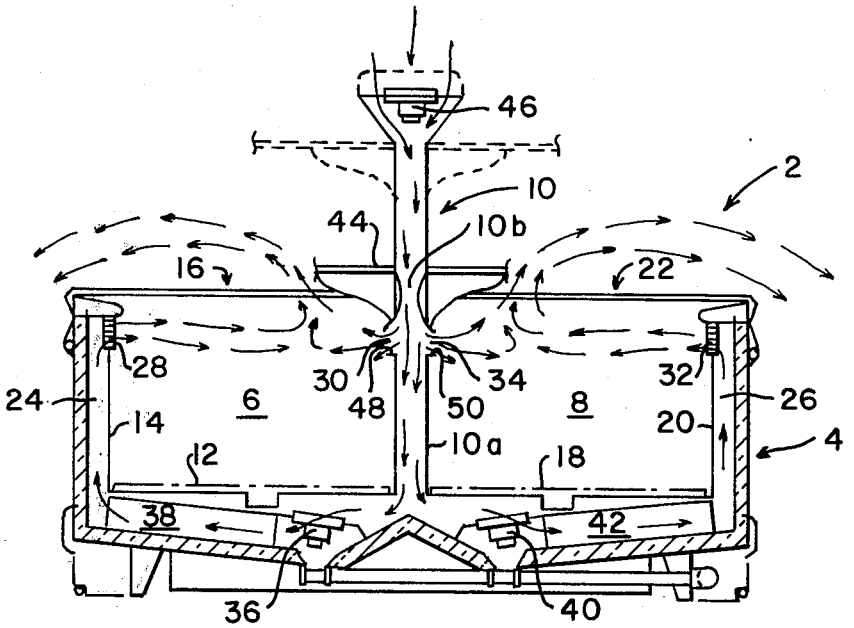
FIG. 2 shows the display case of FIG. 1 in the defrost cycle.

The inner or primary conduits 124 and 126 and their associated fans 136 and 140 and refrigeration coils 138 and 142 correspond to the single conduits 24 and 26 and their associated fans 36 and 40 and refrigeration coils 38 and 42, respectively, shown with respect to the single band embodiment of FIGS. 1 and 2. The multiband cases shown in FIGS. 3 and 4 are described hereafter only with respect to the defrost operation, the air flow direction of which is designated by the arrows in the Figures. A description of the refrigeration operation can be found in the above mentioned co-pending application Ser. No. 145,859.

In the embodiment shown in FIG. 3, a first guard band conduit 150 is formed in the space between the outer cabinet 104 and a conduit divider 152. Primary conduit 124 is defined between the divider 152 and the bottom and side walls 112 and 114 of display space 106. A second guard band conduit 154 is formed in the space between the outer cabinet 104 and a divider 156. Primary band conduit 126 is formed in the space between the divider 156 and the bottom and side walls 118 and 120 of display space 108. Both guard band conduits 150 and 154 share a common return defined between upward extensions of dividers 152 and 156 in the lower part 110*a* of central column 110. A single set of guard band fans 158, preferably and advantageously located at the junction of guard band conduits 150 and 154, draws air from inlets 130 and 134, down through the inner portion of central column 110 between the upward divider extensions 152*a* and 156*a*, into and through conduits 150 and 154, through outlets 128 and 132, and across top access openings 116 and 122 in the form of respective secondary or guard air curtains.

Single and multiband common return cases, of the type shown in FIGS. 1–3, are generally used where the temperatures of the respective display spaces within the main outer cabinet are to be maintained substantially the same.

FIG. 4 shows a multiband island type case in which the temperatures of the respective display spaces 106 and 108 may be maintained independently so that different types of products can be stored in the separate display spaces. Thus, for example, frozen foods such as vegtables, juices, and the like, may be stored in display space 106 and maintained at a desired temperature below 32° F. but above 0° F.; whereas, ice cream may be stored in display space 108 at a temperature maintained below about 0° F.

In FIG. 4, a first guard band conduit 151 extends around display space 106 and is separated from primary conduit 124 by a divider 153. A second guard band conduit 155 extends around display space 108 and is separated from primary conduit 126 by a divider 157. The return portions of conduits 151 and 155 extending up into column 110 are separated from each other by a center divider member 160. In addition, a first set of guard band fans 162 is located in conduit 151 to propel air through conduit 151 and across access opening 116 in the form of a first guard band curtain. A second set of guard band fans 164 is located in conduit 155 to propel air through conduit 155 and across top access opening 122 in the form of a second guard band curtain.

Although not shown, a single band case analogous to the multiband case of FIG. 4 could be constructed by locating a divider member in central column 10 (see FIGS. 1 and 2) in like manner as divider 160, to thereby separate the return portions of conduits 24 and 26.

The multiband cases shown in FIGS. 3 and 4 operate in essentially the same way in the defrost cycle as the single band case shown in FIGS. 1 and 2. If desired, the guard band fans (fans 158 in FIG. 3 and fans 162, 164 in FIG. 4) may be shut off during the defrost cycle when fans 146 are turned on. In this way, the bulk of the ambient air not directed out in inlets 130 and 134 will be drawn substantially only into the primary band conduits 124 and 126 due to the suction created by fans 136 and 140, respectively, to defrost coils 138 and 142.

Figure 5:
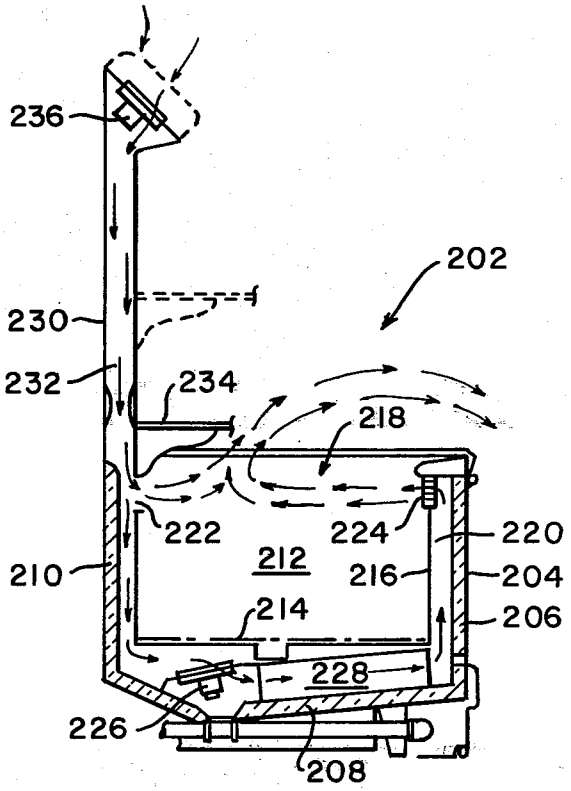
FIG. 5 shows the air defrost arrangement of this invention in conjunction with a well type refrigerated case having a single display space.

FIG. 5 shows a third embodiment of the invention used in an open well case having a single display space of the type that would normally be located against a wall in the food store. In this embodiment, the display case, generally designated 202, has an outer cabinet 204 comprised of a front wall 206, a bottom 208, and a back 210. The outer cabinet 204 contains a storage/display space 212, separated from the outer cabinet 204 by bottom and side walls 214 and 216, respectively, and by a top access opening 218. A main or primary air conduit 220 is formed in the space between the outer cabinet 204 and bottom and side walls 214 and 216 of display space 212. An outlet 222, usually covered by a grille, is disposed near the top of display space 212 along one side of access opening 218. A corresponding return or inlet opening 224 is located across from outlet 222. One or more fans 226 and a set of refrigeration coils 228 are located in conduit 220.

A rear column 230, containing a hollow interior defining a defrost conduit portion 232, extends upwardly from the rear wall 210 of cabinet 204. One or more sets of product display shelves 234 may be mounted to the rear column 230 for storing and displaying non-refrigerated products. A set of defrost fans 236 is located at the top of rear column 230 to selectively draw ambient air from above the outer cabinet 204 into the conduit section 232 during a defrost cycle.

During the normal refrigeration cycle, fans 236 are shut off and fans 226 generate and maintain a continuous air band through conduit 220, and an air curtain across the open top of display space 212. In many commercial installations, the refrigeration cycle air flow direction is substantially clockwise, referring to the orientation of FIG. 5; that is, air flows out of outlet 222, across the case from back to front and enters inlet 224. The defrost cycle of operation of the display case shown in FIG. 5 is essentially the same as for the case shown in FIGS. 1 and 2, except that fans 226 are reversed at the start of the defrost cycle, concurrently with the start up of fans 236, to reverse the direction of air flow through conduit 220 during the defrost cycle. Obviously, the invention described with respect to FIG. 5 could also be used for cases in which the normal refrigeration cycle air flow direction is the opposite to that described above, in which case reversal of fans 226 at the start of the defrost cycle would not be necessary.

The invention is also applicable to multiband open top single display space cases. Such cases operate in substantially the same way as the cases described with respect to FIGS. 3 and/or 4. One such multiband open top display case incorporating the above mentioned reverse air flow (counterclockwise in FIG. 5) during refrigeration is shown in my U.S. Pat. No. 4,106,305, assigned to the same assignee as the present invention.

The electrical circuits for turning on the defrost fans 46, 146 and 236, at the start of a defrost cycle, for shutting off fans 158, 162 and 164, as desired, and for reversing fans 226, as necessary, are well known in the art and would be readily apparent to one skilled in the design and construction of commercial refrigeration apparatus. One such circuit adaptable for use with the present invention is shown in FIG. 3 of my co-pending U.S. patent application Ser. No. 107,261, the pertinent disclosure of which is incorporated herein by reference; it would be readily apparent to one skilled in the art to substitute fans 236 in place of the supplemental heater in the circuit shown in the aforesaid application.

The invention may be embodied in other specific forms without departing from the spirit or essential characteristics thereof. The present embodiments, are, therefore, to be considered in all respects as illustrative and not restrictive, the scope of the invention being indicated by the appended claims rather than by the foregoing description, and all changes which come within the meaning and range or equivalency of the claims are therefore intended to be embraced therein.

What is claimed is:

1. A refrigerated display case, comprising:

an open top cabinet containing at least one well type display space;

primary air conduit means in said cabinet extending around said display space, said primary conduit means containing refrigeration coil means;

defrost conduit means extending upwardly from and communicating with said primary conduit means;

air outlet means and air inlet means of said primary conduit means located on opposite sides of said display space;

main air circulating means for circulating air through said primary conduit means and across the open top of said display space during a refrigeration cycle between the outlet and inlet means in the form of an air curtain;

further air circulating means located in said defrost conduit means; and defrost control means for energizing said further air circulating means at the start of a defrost cycle to draw ambient air from above the refrigerated display case into said defrost conduit means, a first portion of said ambient air being directed out of said defrost conduit means and out of one of said primary conduit inlet means and outlet means substantially in the opposite direction to the flow of the air curtain to collide with said air curtain, at least a portion of said air curtain being thereby reversed and caused to flow over the top of and outside the display case, and a further portion of said ambient air being drawn into said primary conduit means by said main air circulating means to flow through said primary conduit means and over said refrigeration coil means.

2. A refrigeration display case according to claim 1, wherein:

said defrost conduit means extends upwardly from said well type region to a height substantially greater than the height of the cabinet sides.

3. A refrigerated display case according to claim 1 or 2, wherein:

said outlet means are located in said primary conduit means in communication with said defrost conduit means and said inlet means are located in the opposite wall of said cabinet, and said main air circulating means directs the flow of air across said top access opening from said outlet means to said inlet means during a normal refrigeration cycle;

said defrost control means further comprising:

means for reversing the direction of said main air circulating means during a defrost cycle to thereby direct the flow of air through said primary air conduit means in substantially the opposite direction compared to the refrigeration cycle, wherein a portion of said ambient air drawn into the defrost conduit means from above the display case by said further air circulating means during defrost is directed out of said outlet means to collide with said air curtain.

4. A refrigerated display case according to claim 3, wherein:

said defrost conduit means extends upwardly from a rear wall of said cabinet.

5. A refrigerated display case according to claim 3, wherein:

during a defrost cycle, said further air circulating means maintains a pressure differential in said inlet means sufficient to create said flow of ambient air out of said inlet for collision with said air curtain.

6. A refrigerated display case according to claim 5, further comprising:

means located upstream of said inlet means in said defrost conduit means for increasing the velocity of air flowing toward and through said inlet means to thereby increase the momentum of the air flowing out of said inlet means and colliding with said air curtain.

7. A refrigerated display case according to claim 1 or 2, wherein:

during a defrost cycle, said further air circulating means maintains a pressure differential in said inlet means sufficient to create said flow of ambient air out of said inlet for collision with said air curtain.

8. A refrigerated display case according to claim 7, further comprising:

means located upstream of said inlet means in said defrost conduit means for increasing the velocity of air flowing toward and through said inlet means to thereby increase the momentum of the air flowing out of said inlet means and colliding with said air curtain.

9. A refrigerated display case, comprising:

an open top cabinet containing a well type region;

defrost conduit means extending upwardly in said well type region between opposite sides of said cabinet to divide said well type region into separate first and second open top product display spaces;

first air conduit means extending around said first display space within said cabinet, said first air conduit means containing first refrigeration coil means;

first air outlet means and first air inlet means of said first air conduit means located on opposite sides of said first display space;

second air conduit means extending around said second display space within said cabinet, said second air conduit means containing second refrigeration means;

second air outlet means and second air inlet means of said second air conduit means located on opposite sides of said second display space;

wherein said first and second inlet means are located in said column and said defrost conduit means comprises an upwardly extending part of said first and second conduits;

main air circulating means for circulating air through said first and second conduit means, respectively, and across the open tops of said first and second display spaces between the respective outlet means and inlet means in the form of respective air curtains during a refrigeration cycle;

further air circulating means located in said defrost conduit means above said respective first and second inlet means; and defrost control means for energizing said further air circulating means at the start of a defrost cycle to draw ambient air from above the refrigerated display case into said defrost conduit means, first and second portions of said ambient air being directed out of said first and second inlet means to collide with said first and second air curtains flowing toward said first and second inlet means, respectively, at least portions of said air curtains being thereby reversed and caused to flow over the top of and outside the display case, and a further portion of said ambient air being drawn into said first and second conduit means by said main air circulating means to flow through said first and second conduit means and over said first and second refrigeration coil means.

10. A refrigerated display case according to claim 9, wherein:

said defrost conduit means extends upwardly from said well type region to a height substantially greater than the height of the cabinet sides.

11. A refrigerated display case according to claim 9 or 10, wherein:

during a defrost cycle, said further air circulating means maintains a pressure differential in said inlet means sufficient to create said flow of ambient air out of said inlet for collision with said air curtains.

12. A refrigerated display case according to claim 11, further comprising:

means located upstream of said inlet means in said defrost conduit means for increasing the velocity of air flowing toward and through said inlet means to thereby increase the momentum of the air flowing out of said inlet means and colliding with said air curtains.

13. A method of defrosting a well type open top refrigerated display case having primary air conduit means containing refrigeration coils, primary air circulating means, defrost conduit means, and further air circulating means located in said defrost conduit means and communicating with said primary air conduit means, comprising the steps of:

operating said primary air circulating means to cause air to flow through said primary air conduit means, across said coil and across the open top of said display case;

operating said further air circulating means during a defrost cycle to draw ambient air into said defrost conduit means from above said case; and directing a portion of said ambient air out of said defrost conduit means in the opposite direction to the primary flow of air directed across said open top by said primary air circulating means to collide with said primary air flow and to reverse and redirect said primary air flow over the top of and outside the display case.

14. A method according to claim 13, further comprising the step of:

drawing a further portion of said ambient air into said primary conduit upstream of said refrigeration coils and directing said further portion of ambient air across said refrigeration coils.

15. A method according to claim 14, further comprising the step of:

maintaining the air pressure in said defrost conduit during a defrost cycle sufficiently greater than the air pressure in the display case to create said flow of ambient air out of said defrost conduit means for collision with said air curtain.

16. A method according to claim 13 or 15, in which the defrost conduit means extends upwardly in an above said well to divide said well into separate first and second open top display spaces with respective first and second primary air conduit means, each communicating with the defrost conduit means, said method comprising the further step of:

directing substantially equal portions of said ambient air out of said defrost conduit means to collide with the respective air flows across the open tops of said first and second display spaces.

* * * * *